US008980518B2

(12) United States Patent
Roditi et al.

(10) Patent No.: US 8,980,518 B2
(45) Date of Patent: Mar. 17, 2015

(54) LIQUID ELECTROPHOTOGRAPHIC INKS

(75) Inventors: Stella Stolin Roditi, Rehovot (IL); Haim Cohen, Modiin (IL); Neta Filip-Granit, Moshav azrikam (IL); Roi Liraz, Tel Aviv (IL); Eyal Bodinger, Kriat Bialik (IL); Marc Klein, Tel Aviv (IL); Nava Klein, Rishon Le Tzion (IL); Eyal Bachar, Modiin (IL); Swissa Shay, Rehovot (IL); Albert Teishev, Rishon le-zion (IL); Yaron Grinwald, Meitar (IL); Fernanda Orlik, Rehovot (IL); Ilanit Mor, Kiryat Ono (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

(21) Appl. No.: 13/982,993

(22) PCT Filed: Jan. 31, 2011

(86) PCT No.: PCT/US2011/023248

§ 371 (c)(1),
(2), (4) Date: Aug. 21, 2013

(87) PCT Pub. No.: WO2012/105952

PCT Pub. Date: Aug. 9, 2012

(65) Prior Publication Data

US 2014/0314449 A1 Oct. 23, 2014

(51) Int. Cl.

| | |
|---|---|
| ***G03G 9/13*** | (2006.01) |
| ***G03G 9/16*** | (2006.01) |
| ***G03G 15/10*** | (2006.01) |
| ***G03G 9/12*** | (2006.01) |
| ***G03G 9/125*** | (2006.01) |

(52) U.S. Cl.

CPC ..... *G03G 9/16* (2013.01); *G03G 15/10* (2013.01); *G03G 9/12* (2013.01); *G03G 9/125* (2013.01); *G03G 9/132* (2013.01)

USPC ..... 430/112; 430/115

(58) Field of Classification Search

USPC ..... 430/112, 115

See application file for complete search history.

(56) References Cited

U.S. PATENT DOCUMENTS

| | | | |
|---|---|---|---|
| 6,541,173 | B1 | 4/2003 | Kido et al. |
| 7,208,254 | B2 | 4/2007 | Yuasa et al. |
| 2003/0149134 | A1 | 8/2003 | Modi et al. |
| 2009/0029273 | A1 | 1/2009 | Roditi et al. |
| 2009/0047590 | A1 | 2/2009 | Iga |

FOREIGN PATENT DOCUMENTS

| | | |
|---|---|---|
| JP | 60153056 | 8/1985 |
| JP | 2004269732 | 9/2004 |
| JP | 2010500424 | 1/2010 |
| JP | 2010534738 | 11/2010 |
| WO | 2009151446 | 12/2009 |

*Primary Examiner* — Hoa V Le

(74) *Attorney, Agent, or Firm* — Thorpe, North & Western L.L.P.

(57) ABSTRACT

The present disclosure provides for a liquid electrophotographic (LEP) ink comprising a carrier fluid, a pigment, a high melt viscosity ethylene acrylic acid copolymer resin, and a high acid ethylene acrylic acid copolymer resin. The high acid ethylene acrylic acid copolymer resin can have an acid content of at least 15 wt % and a viscosity of at least 8,000 poise. Additionally, the LEP ink can have a total resin acidity of at least 15 wt % and a total resin melt viscosity of at least 20,000 poise.

16 Claims, No Drawings

LIQUID ELECTROPHOTOGRAPHIC INKS

BACKGROUND

Digital printing involves technologies in which a printed image is created directly from digital data, for example using electronic layout and/or desktop publishing programs. Some known methods of digital printing include full-color ink-jet, electrophotographic printing, laser photo printing, and thermal transfer printing methods.

Electrophotographic printing techniques involve the formation of a latent image on a photoconductor surface mounted on an imaging plate. In some examples, the photoconductor is first sensitized to light, usually by charging with a corona discharge, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a rubber offset blanket, from which it is transferred to a substrate, such as paper, plastic or other suitable material, by heat or pressure or a combination of both to produce the printed final image.

The latent image is developed using either a dry toner (a colorant mixed with a powder carrier) or a liquid ink (a suspension of a colorant in a liquid carrier). The toner or ink generally adheres to the substrate surface with little penetration into the substrate. The quality of the final image is largely related to the size of the particles, with higher resolution provided by smaller particles. Dry toners used in solid electrophotography are fine powders with a relatively narrow particle size distribution that are expelled from fine apertures in an application device. Liquid inks used in liquid electrophotography are generally comprised of pigment- or dye-based thermoplastic resin particles suspended in a non-conducting liquid carrier, generally a saturated hydrocarbon.

DETAILED DESCRIPTION

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "carrier fluid," "carrier liquid," or "liquid vehicle" refers to the fluid in which the pigmented resin material of the present disclosure can be dispersed to form an ink dispersion. Such a carrier liquid can be formulated for electrophotographic printing so that the electrophotographic ink has a viscosity and conductivity for such printing, and may include a mixture of a variety of different agents, including without limitation, surfactants, organic solvents and co-solvents, charge control agents, viscosity modifiers, sequestering agents, stabilizing agents, and anti-kogation agents. Though not part of the electrophotographic liquid vehicle per se, in addition to the pigment and resin, the liquid vehicle can further carry solid additives such as resins, latexes, UV curable materials, plasticizers, salts, charge control agents, etc.

As used herein, "co-solvent" refers to any solvent, including organic solvents, present in the electrophotographic liquid vehicle.

As used herein, "pigment" generally includes pigment colorants, magnetic particles, aluminas, silicas, and/or other ceramics, organo-metallics or other opaque particles, whether or not such particulates impart color. Thus, though the present description primarily exemplifies the use of pigment colorants, the term "pigment" can be used more generally to describe not only pigment colorants, but other pigments such as organometallics, ferrites, ceramics, etc. In one specific example, however, the pigment is a pigment colorant.

As used herein, "ethylene acrylic acid copolymer resin" generally refers to both ethylene acrylic acid copolymer resins and ethylene methacrylic acid copolymer resins, unless the context dictates otherwise.

As used herein, "high acid" refers to a resin or copolymer having an acid content of at least 15 wt % measured as the percent of the polymer that is the acid monomer by weight.

As used herein, "high melt viscosity" refers to a resin or copolymer having a melt viscosity of at least 20,000 poise measured by an AR-2000 Rheometer by Thermal Analysis Instruments with a geometry of 25 mm steel plate-standard steel parallel plate. The device can use a plate over plate rheometry isotherm at 120° C., 0.01 Hz shear rate.

As used herein, "substituted" means that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that a liquid electrophotographic (LEP) ink having a pigment, a high melt viscosity acid copolymer resin, and a high acid copolymer resin can provide excellent scratch resistance and durability while maintaining processability.

In accordance with this, the present disclosure is drawn to liquid electrophotographic ink compositions, methods, and systems. It is noted that when discussing the present compositions and associated methods and systems, each of these discussions can be considered applicable to each of these examples, whether or not they are explicitly discussed in the context of that example. For example, in discussing a carrier fluid for use in a liquid electrophotographic ink, such a carrier fluid can also be used for a method of making the liquid electrophotographic ink or an LEP printing system, and vice versa.

With this in mind, a liquid electrophotographic ink can comprise a carrier fluid, a pigment, a high melt viscosity ethylene acrylic acid copolymer resin, and a high acid ethylene acrylic acid copolymer resin. The high acid ethylene acrylic acid copolymer resin can have an acid content of at least 15 wt % and a viscosity of at least 8,000 poise. Generally, the LEP ink can have a total resin acidity of at least 15 wt % and a total resin melt viscosity of at least 20,000 poise.

It has been discovered, as described herein, that certain resin profiles that can be used in LEP inks provide durable and scratch resistant images when printed. As such, the present LEP inks generally include a resin content comprising a high melt viscosity ethylene acrylic acid copolymer resin and a high acid ethylene acrylic acid copolymer resin. As mentioned, the resin content can provide an LEP ink having a total resin acidity of at least 15 wt % and a total resin melt viscosity of at least 20,000 poise. Generally, the present inks may include other copolymers/resins, including those that have a resin melt viscosity of less than 20,000 poise and/or a resin acidity of less than 15 wt %, provided that the total resin content maintains a total resin acidity of at least 15 wt % and a total resin melt viscosity of at least 20,000 poise. However, in one example, the LEP ink can exclude resins/copolymers having a viscosity of less than 8,000 poise. Additionally, in another example, the LEP ink can exclude resins/copolymers having an acidity of less than 15 wt %.

In some more specific examples, the high acid ethylene acrylic acid copolymer resins described herein have an acid content of at least 18 wt %. In another example, the high acid ethylene acrylic acid copolymer resin can have an acid content of at least 20 wt %. In still another example, the high melt viscosity ethylene acrylic acid copolymer resin can have a melt viscosity of at least 100,000 poise, or in some embodiments, at least 200,000 poise. The high melt viscosity ethylene acrylic acid copolymer resin and/or the high acid ethylene acrylic acid copolymer resin can also both have a molecule weight ($M_w$) of at least 40,000.

Generally, the high melt viscosity ethylene acrylic acid copolymer resin and the high acid ethylene acrylic acid copolymer resin are present in such an amount to allow compatibility between the copolymers. As such, the copolymers can be added in corresponding amounts such that they can mix and encapsulate pigments during processing to form the LEP ink. In one example, the high melt viscosity ethylene acrylic acid copolymer resin and the high acid ethylene acrylic acid copolymer resin can be present in the LEP ink at a ratio of 10:1 to 1:10 by weight. In another example, the high melt viscosity ethylene acrylic acid copolymer resin and the high acid ethylene acrylic acid copolymer resin can be present in the LEP ink at a ratio of 8:2 to 6:4 by weight. Generally, the high melt viscosity ethylene acrylic acid copolymer resin can be present in the LEP ink at an amount of about 5 wt % to about 50 wt %. Additionally, the high acid ethylene acrylic acid copolymer resin can be present in the LEP ink in an amount of about 1 wt % to about 40 wt %.

The LEP inks described herein can also include a charge director. Generally, the charge director can be a negative charge director (NCD) or a synthetic charge director (SCD). In one example, the charge director can be an NCD comprising a mixture of charging components. In another example, the NCD can comprise at least one of the following: zwitterionic material, such as soya lecithin; basic barium petronate (BBP); calcium petronate; isopropyl amine dodecylebenzene sulfonic acid; etc. In one specific non-limiting example, the NCD can comprise soya lecithin at 6.6% w/w, BBP at 9.8% w/w, isopropyl amine dodecylebenzene sulfonic acid at 3.6% w/w and about 80% w/w isoparaffin (Isopar®-L from Exxon). Additionally, the NCD can comprise any ionic surfactant and/or electron carrier dissolved material. In one example, the charge director can be a synthetic charge director. The charge director can also include aluminum tri-stearate, barium stearate, chromium stearate, magnesium octoate, iron naphthenate, zinc napththenate, and mixtures thereof.

As described generally, the present compositions and methods are directed towards pigmented liquid electrophotographic inks. As such, the pigments can be organic pigments of any color. Thus, the pigments can be organic and/or inorganic pigments. In one aspect, the pigments can be inorganic pigments. In one specific aspect, the pigments can include metal, metal salts, metal compounds such as metal oxides, and coordinate complexes including their hydrates. Additionally, in one example, the pigments can include aryl groups. In other examples, the pigments can include olefinic groups and/or systems. The pigment can be present in the liquid electrophotographic ink from about 0.01 wt % to about 60 wt % of solids. In still other examples, the pigment can be present from about 0.1 wt % to about 40 wt % of the solids of liquid electrophotographic ink.

Generally, the liquid electrophotographic ink can include a carrier fluid such as an aliphatic solvent including substituted or unsubstituted, linear or branched, aliphatic compounds. Additionally, such solvents can include aryl substituents. In one example, the aliphatic solvent can be substantially non-aqueous, i.e. containing less than 0.5 wt % water. In another example, the aliphatic solvent can be nonaqueous. The aliphatic solvent can comprise a member selected from the group of paraffins, isoparaffins, oils, alkanes having from about 6 to about 100 carbon atoms, and mixtures thereof.

The liquid electrophotographic ink can also include an aliphatic hydrocarbon, such as a paraffin and/or isoparaffin. As such, the aliphatic solvent. or carrier fluid can comprise, or substantially comprise, or even consist essentially of isoparaffins, such as or equivalent to the ISOPAR® high-purity isoparaffinic solvents with narrow boiling ranges marketed by Exxon Mobil Corporation (Fairfax, Va., USA). Also suitable as an aliphatic solvent or cosolvent, for implementing examples of the present invention are alkanes having from about 6 to about 14 carbon atoms such as solvents sold under the NORPAR® (NORPAR® 12, 13 and 15) tradename available from Exxon Mobil Corporation (Fairfax, Va., USA). Other hydrocarbons for use as an aliphatic solvent, or cosolvent, are sold under the AMSCO® (AMSCO® 460 and OMS) tradename available from American Mineral Spirits Company (New York, N.Y., USA), under the SOLTROL® tradename available from Chevron Phillips Chemical Company LLC (The Woodlands, Tex., USA) and under the SHELLSOL® tradename available from Shell Chemicals Limited (London, UK). Such an aliphatic solvent, or cosolvent, can have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, low surface tension, low latent heat of vaporization and low photochemical reactivity.

As previously discussed, the liquid electrophotographic inks described herein can include others resins/copolymers. Such resins/copolymers can be polymerized from monomers selected from the group of ethylene acrylic acid, ethylene methacrylic acid, ethylene acrylic ester maleic anhydride, ethylene acrylic ester glycidyl methacrylate, maleic anhydride, styrene maleic anhydride, and mixtures thereof. These resins can also encapsulate the pigment during grinding or mixing to create composite particles of pigment and resin. Generally, the composite particles can have a final particle size from about 1 micron to about 10 microns and produce a printed image at thickness of about 1 micron per separation. The composite particles can be formulated to provide a specific melting point. In one example, the melting point can be from about 30° C. to about 100° C. In another example, the melting point can be from about 50° C. to about 90° C. Such melting points can allow for desired film formation during printing. Additionally, the present LEP inks can comprise a wax. The wax can be used to help provide for desired melting points. Also, liquid electrophotographic inks can have a conductivity of less than about 300 pS/cm. In one example, the liquid electrophotographic inks can have a conductivity of less than about 200 pS/cm, or in another example, even less than about 100 pS/cm.

The liquid electrophotographic ink compositions of the present disclosure can also be suitable for use on many types of substrates of recording media, including but not limited to vinyl media, cellulose-based paper media, various cloth materials, polymeric materials (non-limitative examples of which include polyester white film or polyester transparent film), photopaper (non-limiting examples of which include polyethylene or polypropylene extruded on one or both sides of paper), metals, and/or mixtures or composites thereof.

Additionally, a method of manufacturing an LEP ink can comprise mixing a carrier fluid, a high acid ethylene acrylic acid copolymer resin having an acid content of at least 15 wt % and a melt viscosity of at least 8000 poise, and a high melt viscosity ethylene acrylic acid copolymer resin having a melt viscosity of at least 20,000 poise to form a resin mixture; heating the resin mixture until the copolymers have melted; cooling the resin mixture to form composite resin particles; grinding the resin particles with a pigment to form composite particles, e.g., of pigment and resin; and combining the composite particles with the carrier fluid to form the LEP ink. In one example, the method can further comprise charging the composite particles. While the present method steps are listed sequentially, it is understood that such steps are not necessarily performed in the recited order. For example, in one example, the step of mixing a carrier fluid, a high acid ethylene acrylic acid copolymer resin, and a high melt viscosity ethylene acrylic acid copolymer resin, and the step of heating can be performed simultaneously.

In addition to the above, an LEP printing system can comprise an LEP printer, and an LEP ink as described herein loaded therein. Again, in addition to the other properties described herein with respect to the LEP inks, the high acid ethylene acrylic acid copolymer resin can be present in the liquid electrophotographic ink at an amount of about 1 wt % to about 40 wt %, and the high melt viscosity ethylene acrylic acid copolymer resin can be present in the liquid electrophotographic ink at an amount of about 5 wt % to about 50 wt %, the melting point of both resins is from about 30° C. to about 100° C., and/or the liquid electrophotographic ink has a conductivity of less than about 300 pS/cm.

Generally, the present methods, compositions, and systems provide an LEP ink that is durable and scratch resistant when printed. In one example, such durability can be measured by a scratch resistance test between the LEP ink and a comparable LEP ink having a total resin acidity of less than 15 wt % or a total resin melt viscosity of less than 20,000 poise (where the ink is otherwise identical). Scratch resistance testing can be performed by a Taber® Shear&Scratch tester model no. 551 using a contour shear tool (precision ground tungsten carbide has a cutting edge lapped to a 25 mm radius with a 30° clearance S-20. The edge is set at a 22° shear angle in relation to the rotation of the table). In another example, the durability can be measured by a rub resistance test between the LEP ink and a comparable LEP ink having a total resin acidity of less than 15 wt % or a total resin melt viscosity of less than 20,000 poise, where the rub resistance test is performed by Sutherland® rub tester for 100 cycles at a speed setting of 2. The present LEP inks can also maintain excellent adhesion. The adhesion can be measured by an adhesion test where an adhesive tape (3M Scotch® Drafting Tape 230) can be applied to printed ink. The tape can be peeled from the substrate, e.g. paper, and the % of the damaged area can be measured by scanning the tested print area and comparing it to a non-damaged area.

EXAMPLES

The following examples illustrate a number of variations of the present compositions and methods that are presently known. However, it is to be understood that the following are only exemplary or illustrative of the application of the principles of the present compositions and methods. Numerous modifications and alternative compositions and methods may be devised by those skilled in the art without departing from the spirit and scope of the present compositions and methods. The appended claims are intended to cover such modifications and arrangements. Thus, while the present compositions and methods have been described above with particularity, the following examples provide further detail in connection with what are presently deemed to be acceptable.

Example 1

Preparation of Liquid Electrophotographic Ink

A high melt viscosity ethylene acrylic acid copolymer resin (700 grams of Nucrel® 925 by DuPont™ Co.), a high acid ethylene acrylic acid copolymer resin (300 grams of Nucrel® 2806 by DuPont™ Co.), and isoparaffin (1500 grams of Isopar L® by Exxon Mobile Corp.) were mixed in a double planetary mixer at a ratio of the high melt viscosity ethylene acrylic acid copolymer resin to the high acid ethylene acrylic acid copolymer resin of 70:30 w/w, respectively to provide about 40 wt % non-volatile solids. The paste was heated to a temperature of 130° C. during mixing and cooled to room temperature of approximately 22° C. over a period of about 3 hours. This paste was combined with pigment, polyethylene wax, charge adjuvant, and Isopar L®, in the amounts listed in Table 1 in an attritor. The mixture was grinded for 1.5 hours at 50° C. (hot stage) followed by 10.5 hours at 37° C. (cold stage) at 250 rpm to obtain the liquid electrophotographic ink.

TABLE 1

| Component | Weight (g) | Solids (g) | % solids by weight | % ink solids by weight |
|---|---|---|---|---|
| Resin Paste | 776 | 310 | 40 | 75 |
| pigment | 79 | 79 | 100 | 19 |
| polyethylene wax | 19 | 19 | 100 | 4.6 |
| charge adjuvant | 6 | 6 | 100 | 1.4 |
| Isopar L ® | 1426 | 0 | 0 | 0 |
| Total | 2306 | 414 | 18 | — |

Example 2

Preparation of Comparative Liquid Electrophotographic Ink No. 1

The comparative ink was prepared with the components, the specific amounts, and under the specific conditions of Example 1, except the resin mixture was a copolymer of ethylene and methacrylic acid (Nucrel® 699 by DuPont™ Co.) having a melt viscosity of 26,000 poise and 11 wt % acid and an ethylene acrylic acid copolymer resin (A-C® 5120 by Honeywell Co.) having a melt viscosity of 15 poise and 15 wt % acid, in an 80:20 w/w ratio, respectively. The total resin melt viscosity of the ink was 5600 poise.

Example 3

Preparation of Comparative Liquid Electrophotographic Ink No. 2

The comparative ink was prepared with the components, the specific amounts, and under the specific conditions of Example 1, except the resin mixture was (Nucrel® 960 by DuPont™ Co.) having a melt viscosity of 74,000 poise and 15 wt % acid, a copolymer of ethylene and methacrylic acid (Nucrel® 699 by DuPont™ Co.) having a melt viscosity of 26,000 poise and 11 wt % acid and an ethylene acrylic acid copolymer resin (A-C® 5120 by Honeywell Co.) having a melt viscosity of 15 poise and 15 wt % acid in an 65:15:20 w/w ratio, respectively. The total resin melt viscosity of the ink was 11,400 poise.

Example 4

Durability Data

The liquid electrophotographic ink of Example 1, Comparative Liquid Electrophotographic Ink No. 1 of Example 2, and the Comparative Liquid Electrophotographic Ink No. 2 of Example 3 were printed and measured in the following manner. All three inks were printed on a paper substrate. After printing, the printed ink was allowed to dry and was measured for durability using a scratch resistance test, a rub resistance test, and an adhesion test as described hereafter. The scratch resistance test included printing at 400% coverage and scratching with Taber® Shear&Scratch tester model no. 551 using a contour shear tool (precision ground tungsten carbide has a cutting edge lapped to a 25 mm radius with a 30° clearance S-20. The edge is set at a 22° shear angle in relation to the rotation of the table). The weight of the debris was measured and is reported in Table 2 below. The rub resistance test included printing at 100% coverage. After 24 hours, the printed ink was measured by rubbing with a Sutherland® Rub Tester using a 4 lb block for 100 cycles at a speed setting of 2. The percent of ink remaining on the paper is reported in Table 2 below. The adhesion test included printing at 100%. After 10 minutes, an adhesive tape (3M Scotch® Drafting Tape 230) was applied to the printed ink. The tape was peeled from the paper and the % of the damaged area was measured by scanning the tested print area and comparing it to a non-damaged area, which is reported in Table 2.

The following results, summarized in Table 2, were obtained:

TABLE 2

| | LEP INK Example 1 | Comparative Ink No. 1 Example 2 | Comparative Ink No. 2 Example 3 |
|---|---|---|---|
| Scratch Resistance (μg) ink removed | 5 | 370 | 30 |
| Rub resistance % ink remaining | 83 | 71 | 63 |
| Adhesion % ink remaining | 90 | 89 | 67 |

As can be seen in Table 2, the LEP inks as presently disclosed can provide significant improved durability as compared to comparative LEP inks. The durability can be measured as improved scratch resistance and/or improved rub resistance. Additionally, the present inks maintained adhesion while providing significantly improved durability.

While the disclosure has been described with reference to certain examples, those skilled in the art will appreciate that various modifications, changes, omissions, and substitutions can be made without departing from the spirit of the disclosure. It is intended, therefore, that the invention be limited only by the scope of the following claims.

What is claimed is:

1. A liquid electrophotographic ink, comprising:
a carrier fluid;
a pigment;
a high melt viscosity ethylene acrylic acid copolymer resin; and
a high acid ethylene acrylic acid copolymer resin having an acid content of at least 15 wt % and a viscosity of at least 8,000 poise;
wherein the liquid electrophotographic ink has a total resin acidity of at least 15 wt % and a total resin melt viscosity of at least 20,000 poise.

2. The liquid electrophotographic ink of claim 1, wherein the high acid ethylene acrylic acid copolymer resin has an acid content of at least 18 wt %.

3. The liquid electrophotographic ink of claim 1, wherein the ink excludes resins having a viscosity of less than 8,000 poise.

4. The liquid electrophotographic ink of claim 1, wherein the high melt viscosity ethylene acrylic acid copolymer resin has a melt viscosity of at least 20,000 poise.

5. The liquid electrophotographic ink of claim 1, wherein the carrier fluid is an aliphatic hydrocarbon selected from the group of a paraffin, an isoparaffin, oils, alkanes having from about 6 to about 100 carbon atoms, and mixtures thereof.

6. The liquid electrophotographic ink of claim 1, wherein the high melt viscosity ethylene acrylic acid copolymer resin and the high acid ethylene acrylic acid copolymer resin are present in the liquid electrophotographic ink at a ratio of 10:1 to 1:10 by weight.

7. The liquid electrophotographic ink of claim 1, wherein the high melt viscosity ethylene acrylic acid copolymer resin and the high acid ethylene acrylic acid copolymer resin are present in the liquid electrophotographic ink at a ratio of 8:2 to 6:4 by weight.

8. The liquid electrophotographic ink of claim 1, wherein the high acid ethylene acrylic acid copolymer resin is present in the liquid electrophotographic ink at an amount of about 1 wt % to about 40 wt %, and the high melt viscosity ethylene acrylic acid copolymer resin is present in the liquid electrophotographic ink at an amount of about 5 wt % to about 50 wt %.

9. The liquid electrophotographic ink of claim 1, further comprising a wax.

10. A method of manufacturing the liquid electrophotographic ink of claim 1, comprising:

mixing a first portion of the carrier fluid, the high add ethylene acrylic add copolymer resin having an acid content of at least 15 wt % and a melt viscosity of at least 8000 poise, and the high melt viscosity ethylene acrylic add copolymer resin to form a resin mixture;

heating the resin mixture until the resins have melted;

cooling the resin mixture to form composite resin particles;

grinding the resin particles with a pigment to form composite particles; and combining the composite particles with a second portion of the carrier fluid to form the liquid electrophotographic ink, wherein the liquid electrophotographic ink has a total resin acidity of at least 15 wt % and a total resin melt viscosity of at least 20,000 poise.

11. The method of claim 10, further comprising charging the composite particles.

12. The method of claim 10, wherein the steps of mixing and heating are performed simultaneously.

13. The method of claim 10, wherein the grinding step or the combining step include adding a charge director and a wax.

14. A liquid electrophotographic printing system, comprising:

a liquid electrophotographic printer; and a liquid electrophotographic ink loaded in the liquid electrophotographic printer, the liquid electrophotographic ink, including:

a carrier fluid;

a pigment;

a high melt viscosity ethylene acrylic acid copolymer resin; and a high acid ethylene acrylic acid copolymer resin having an acid content of at least 15 wt % and a viscosity of at least 8,000 poise;

wherein the liquid electrophotographic ink has a total resin acidity of at least 15 wt % and a total resin melt viscosity of at least 20,000 poise.

15. The liquid electrophotographic printing system of claim 14, wherein the high acid ethylene acrylic acid copolymer resin is present in the liquid electrophotographic ink at an amount of about 1 wt % to about 40 wt %, and the high melt viscosity ethylene acrylic acid copolymer resin is present in the liquid electrophotographic ink at an amount of about 5 wt % to about 50 wt %, the melting point of both resins is from about 30° C. to about 100° C., and the liquid electrophotographic ink has a conductivity of less than about 300 pS/cm.

16. The method of claim 10, wherein the high melt viscosity ethylene acrylic acid copolymer resin has a melt viscosity of at least 20,000 poise.

* * * * *

UNITED STATES PATENT AND TRADEMARK OFFICE

CERTIFICATE OF CORRECTION

PATENT NO. : 8,980,518 B2
APPLICATION NO. : 13/982993
DATED : March 17, 2015
INVENTOR(S) : Stella Stolin Roditi et al.

It is certified that error appears in the above-identified patent and that said Letters Patent is hereby corrected as shown below:

In the claims

In column 9, line 15, in Claim 10, delete “add” and insert -- acid --, therefor.

In column 9, line 16, in Claim 10, delete “add” and insert -- acid --, therefor.

In column 9, line 19, in Claim 10, delete “add” and insert -- acid --, therefor.

Signed and Sealed this
Fifteenth Day of December, 2015

Michelle K. Lee

Michelle K. Lee
*Director of the United States Patent and Trademark Office*